US005351507A

United States Patent [19]

Derman

[11] Patent Number: 5,351,507

[45] Date of Patent: Oct. 4, 1994

[54] WIRE CABLE LOCKING DEVICE

[76] Inventor: Jay S. Derman, P.O. Box 949, Redondo Beach, Calif. 90277

[21] Appl. No.: 63,156

[22] Filed: May 18, 1993

[51] Int. Cl.[5] ..... E05B 73/00

[52] U.S. Cl. ..... 70/18; 70/58; 70/DIG. 57; 248/553

[58] Field of Search ..... 70/18, 57, 58, DIG. 57; 42/70.11, 70.01; 248/551-553

[56] References Cited

U.S. PATENT DOCUMENTS

| | | | |
|---|---|---|---|
| 1,358,184 | 11/1920 | Voight | 70/58 X |
| 1,681,409 | 8/1928 | Johnson | 70/18 |
| 2,327,334 | 8/1943 | Parker | 42/70.11 |
| 3,101,695 | 8/1963 | Honeyman, Jr. | 70/57 X |
| 3,765,197 | 10/1973 | Foote | 70/58 |
| 3,798,934 | 3/1974 | Wright et al. | 70/18 X |
| 3,859,826 | 1/1975 | Singer et al. | 70/58 |
| 4,055,973 | 11/1977 | Best | 70/18 X |
| 4,065,946 | 1/1978 | Loynes et al. | 70/58 |
| 4,667,491 | 5/1987 | Lokken et al. | 70/18 X |
| 5,271,174 | 12/1993 | Bentley | 42/70.11 |

FOREIGN PATENT DOCUMENTS

| | | | |
|---|---|---|---|
| 2608807 | 9/1977 | Fed. Rep. of Germany | 70/58 |

*Primary Examiner*—Lloyd A. Gall
*Attorney, Agent, or Firm*—Monty Koslover Assoc.

[57] ABSTRACT

A device for securing equipments such as personal computers, monitors, printers and the like by using a cable which is secured to a relatively immovable fixture. The device comprises a wire cable with a plastic sheath and having a bulbous protrusion on one end, a plurality of fastener blocks, a metal ring and a cam lock assembly. The cable locking device is secured to various equipments by fastener blocks with the cable passing through the blocks, the bulbous protrusion on the cable end preventing the cable from being pulled through the blocks. The free end of the cable is looped around a suitable pillar or immovable object, passing through a ring and thence through a cam lock assembly. By turning a key in the cam lock, the lock assembly is clamped to the cable, preventing the cable loop from being removed. Access to the screws holding the blocks to the equipment is prevented by the cable passing through the blocks above the screws. The invention can also be used without the fastener blocks, to secure guns and rifles from accidental use, by passing the cable through the barrel and clamping the cable by the lock assembly in the gun breech.

5 Claims, 2 Drawing Sheets

WIRE CABLE LOCKING DEVICE

BACKGROUND AND SUMMARY OF THE INVENTION

This invention relates to a wire cable locking device useful for securing equipments such as personal computers, monitors, printers, video cassette recorders and other expensive electronic devices, preventing them from being easily removed by unauthorized persons. The invention may also be used for locking guns and rifles of all types, preventing their use.

There are numerous cable locking devices patented and for sale, the most common application being for locking bicycles. There are armored cables, as well as many different types of locking mechanisms. There is not however, a simple cable locking device which can be used for securing equipment such as computers and auxiliary equipment which are portable, easily removed, and the object of much theft from unattended offices. Therefore, there is a need for the present invention.

The present invention for a wire cable locking device was disclosed to the USPTO under the Disclosure Document Program filed Sep. 1, 1992.

In accordance with the invention, the device comprises a wire cable with a plastic sheath and having a bulbous attachment on one end and a stop sleeve on the other end, a plurality of fastener blocks, a metal ring and a cam lock assembly. The cable locking device is secured to various equipments by fastener blocks with the cable passing through the blocks. The free end of the cable is looped around a suitable pillar or immovable object, passing through a ring and thence through a cam lock assembly. By turning a key in the cam lock, the lock assembly is clamped to the cable, preventing the cable loop from being removed. A bulbous attachment on the other end of the cable prevents the cable from being pulled through and disengaged from the equipment fastener blocks.

The invention can also be utilized with the cable loop placed through a padlock secured to an apparatus electrical cord. Both the foregoing methods will effectively secure the equipments from removal and deter theft.

Another use of the invention is for locking guns and rifles. In this mode of use, the fastening blocks would not be needed, the cable and lock assembly being sufficient, as explained in this specification, to prevent usage of the locked gun or rifle.

Accordingly, a prime object of the invention is to provide a wire cable locking device which permits simultaneously securing a plurality of equipments with one key lock.

Another object is to provide a wire cable locking device which is of low cost, easy to use, flexible and adaptable to different physical equipment layouts.

Further objects and advantages of the present invention will become apparent from the study of the following portion of the specification, the claims and the attached drawings.

DESCRIPTION OF THE PREFERRED EMBODIMENT

Figures 1, 2, 3, 4, 5, 6:
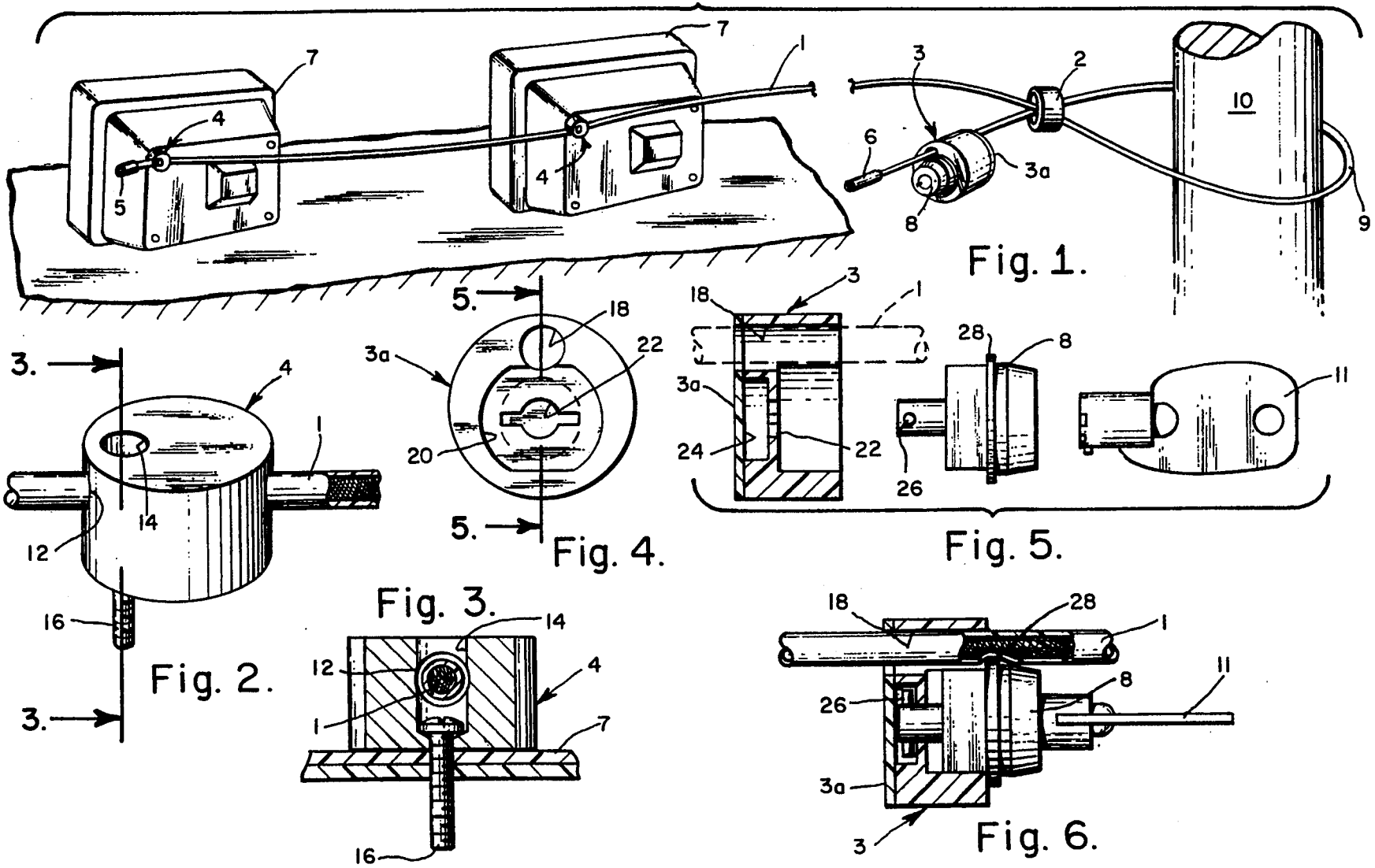
FIG. 1 is a generally perspective view showing the preferred embodiment wire cable locking device of the present invention being used to secure two equipments.
FIG. 2 is a perspective view of a fastener block used to fasten equipment to the wire cable locking device.
FIG. 3 is an elevation cross-section view of a fastener block taken along line 3—3 of FIG. 2, and particularly showing how the cable passes through the fastener block above the fastening screw, preventing access to the screw head.
FIG. 4 is a top view of a lock base which is used together with a cam lock to form a cam lock assembly which secures the loop of the cable locking device.
FIG. 5 is an exploded view of the cam lock assembly, showing a sectional view of the lock base taken along line 5—5 of FIG. 4, a cam lock and a key.
FIG. 6 is a partial sectional view of an assembled cam lock assembly on the wire cable, particularly showing the cam lock deforming the wire cable and securing the lock assembly to the cable.
Figure 7:
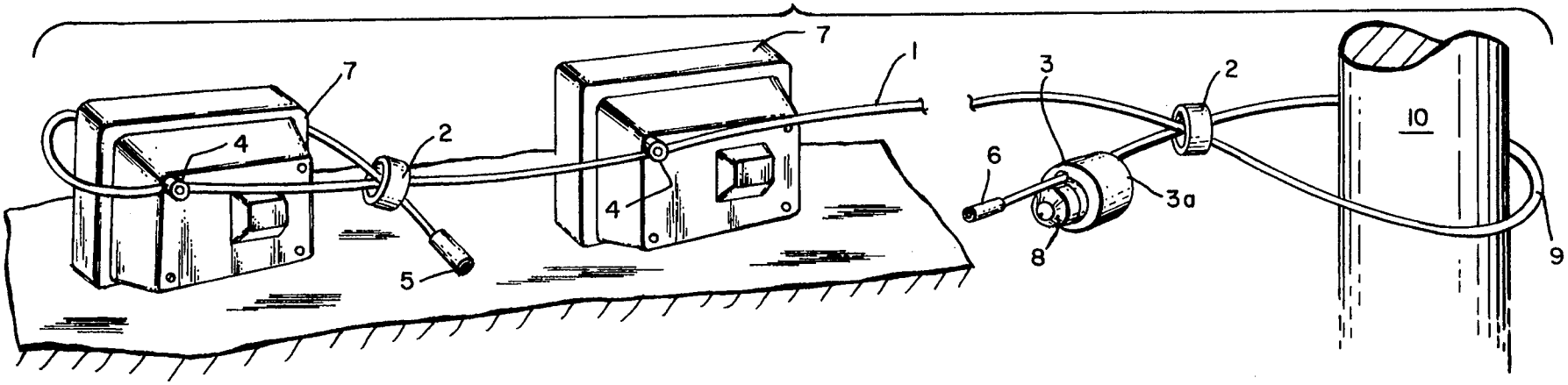
FIG. 7 illustrates the cable wrapped around the computer.

Referring particularly to the drawings, there is shown in FIG. 1 a perspective view of a preferred embodiment, of the present invention, being used to secure two equipments 7 by means of a cable loop 9 to a fixture 10. The device comprises a wire cable 1 having a plastic sheath, a metal ring 2, a cam lock assembly 3, and a multiplicity of fastener blocks 4. On one end of the cable 1 is clamped a hard, bulbous protrusion 5, and on the other end is clamped a metal sleeve 6. The protrusion 5 acts to prevent the cable 1 from being pulled completely through a fastener block 4 and so disengaging the cable locking device, The metal sleeve 6 prevents the cam look assembly 3 from coming off the cable.

FIGS. 2 and 3 show a fastener block 4 configuration and detail of its use. When the locking device is being used in the configuration shown in FIG. 1, one or more fastener blocks 4 are first attached by a screw 16 to equipment 7. The cable 1 sleeve end 6 is then passed through a first hole 12 in each fastener block 4, through a metal ring 2, around an immovable fixture 10 and back through the ring 2, forming a loop 9 around the fixture 10. The cable 1 sleeve end 6 is then pushed through a bore 18 in the base 3*a* of the cam lock assembly 3, and the cam lock 8 is inserted in the base 3*a* and locked by a key 11. An edge of the cam lock 8 bears hard against the plastic cover of the cable 1, deforming it substantially and clamping the lock assembly 3 to the cable 1 preventing cable movement and opening the cable loop which is around a fixture 10.

Each fastener block 4 is made from a metal or hard plastic material, shaped preferably in a cylindrical form. A first hole 12, sized to accommodate the cable I, is bored through the block horizontally, perpendicular to the block cam axis and near to the top surface of the block 4. A second hole 14 is bored vertically, near the block edge and through the first hole 12. This second hole 14 is initially sized to accommodate the head of an equipment fastening screw 16, and is continued to near the bottom of the block where it is then sized for the screw body, thus allowing for a screw 16 to be retained by the fastener block 4.

As shown in FIG. 3, when a screw 16 is used to, fasten a block 4 to an equipment 7, passing the cable 1 through the first hole 12 prevents access to the screw 16 head and its removal.

Referring now to FIGS. 4, 5 and 6 there are shown views and detail of the lock base 3*a*, an exploded view with cutaway section of the cam lock assembly 3, and a partial sectioned view of the cam lock assembly 3 locked in place on the cable 1. The cam lock assembly 3 comprises three parts: a lock base 3*a*, a cam lock member 8 and a key 11. The lock base 3*a* is made of a hard molded plastic or metal. A bore hole 18 is formed, vertically through the base 3*a*, near to its circumference, and sized to accommodate the cable 1 with extra clearance for the sleeve 6 end.

A first cavity 20 sized and shaped to seat the lower body of the cam lock member 8 is formed around the vertical axis of the lock base 3*a*, and a second cavity 24 to retain the cam lock pins 26 is formed underneath the first cavity. A second hole 22 and slot is cut on the center at the bottom of the first cavity 20, connecting the first (top) cavity to the lower cavity. The first cavity 20 is generally circular in shape and has two opposing flat sides. These flat sides mate with flats on the body of the lock member 8 and prevent the look member body from being rotated.

The lock member 8 is a standard cylindrical cam type which has been adapted in body size to the depth and shape of the first cavity 20 in the lock base 3*a*. It includes horizontally protruding pins 26 attached to the end of the center lock column, flats on two opposing sides of its lower body, and a ring 28 on the lower part of the member head. The pins 26 act to retain the lock member 8 when they are inserted through the slot 22 and into the lower cavity 24 of the lock base 3*a*, and the lock barrel is turned by a key 11.

As shown in FIG. 6, the ring 28 protrudes into the plastic sheathing of the cable 1, deforming the cable and effectively clamping it to the cam lock assembly 3.

Referring again to FIG. I, it is seen that the configuration of the wire cable locking device includes a loop 9, which in the illustrated case, is used to anchor the cable to a fixture such as a column 10. The device does not have to be used only in the illustrated manner.

For equipments such as portable "Notebook" type PC's for example, it may not be practical to secure them directly with fastener blocks 4. In these PC's, the screen is attached by a hinge to the keyboard and processors. The invention locking device would be used by wrapping the cable loop 9 around the PC screen at the hinge undercut portion, and tightening the loop 9 by drawing in the cable 1 and locking the cam lock assembly 3 tight against the ring 2. One or more fastener blocks 4 at the other end of the cable, would be used to fasten to a rigid, relatively immovable object, thus securing the equipment.

Other variations are possible, including using a cable loop 9 at both cable ends, using also an extra ring 2 and cam lock assembly 3, instead of or in addition to using the fastener blocks 4.

The invention wire cable lock assembly is thus, versatile and adaptable to various equipment configurations and sizes. Another possible application of the invention cable lock assembly is to use it as a gun or rifle lock. In this application, the fastener blocks 4 would not be needed, and the device would comprise only a wire cable 1 and a cam lock assembly 3. As before, the cable 1 has a bulbous protrusion 5 attached at one end and a metal stop sleeve 6 attached at its distal end. When used for securing a gun or rifle, the cable metal sleeve end 6 is inserted in the muzzle and pulled through the barrel until the end protrusion 5 pulls up hard against the muzzle. The cam lock assembly 3 is slid onto the cable 1 and locked, clamped in place at the gun breech. This will effectively prevent any firing of the weapon until the cable 1 can be removed, providing a safety lock against children or others attempting to play with the weapon.

In a variation of the above configuration, a cable loop may be used at the breech end, looping the cable through a part of the gun before clamping the cable with the cam lock assembly. In some gun and rifle types, where the cable loop method is preferred, the use of a ring may be required to properly secure the loop. In each application, the length and size of the cable and its attachments can be matched to the size of the weapon as required to avoid pulling through the barrel the cable end bulbous protrusion and having excess lengths of cable.

The foregoing describes some of the ways the invention may be used. There are undoubtedly many others, not mentioned here. It is seen to be a simple, versatile locking device, intended primarily for securing expensive, electronic equipment such as PC's, monitors, VCR's etc., but also for safety locking guns against children's misuse.

From the above description, it is clear that the preferred embodiment achieves the objects of the present invention. Alternative embodiments and various modifications may be apparent to those skilled in the art. These alternatives and modifications are considered to be within the spirit and scope of the present invention.

Having described the invention, what is claimed is:

1. A wire cable locking device for securing equipments including portable laptop PC's, comprising:

(a) a plastic sheathed wire cable; said wire cable having a hard bulbous protrusion attached at one end and a metal sleeve attached to its distal end; said wire cable forming a loop at near its metal sleeve end and another loop at near its bulbous protrusion end;

(b) a metal ring; said metal ring being used to form a cable loop by passing an end of said cable through said ring twice;

(c) a cam lock assembly comprising:

a lock body member defining a planar zone having a width and depth;

first means including a first opening running through said lock body member and adapted to fit said wire cable diameter, allowing said wire cable to pass through said first opening;

second means including a cavity in said lock body member, said cavity spaced parallel to and adjacent to said first means;

third means including a look element member, fitting in said look body member cavity, having one position within said planar zone for locking said lock element member;

one of said wire cable loops being passed around a portion of a portable equipment and said one loop clamped tightly by a suitable clamp device; the other said wire cable loop being passed around a relatively immovable fixture, through said ring and clamped by said cam lock assembly which prevents said wire cable from being disconnected from said immovable fixture.

2. The wire cable locking device as defined in claim 1, wherein a sufficient length of said wire cable projects through said lock body member of said cam lock assembly, said lock element member being pushed tight against said wire cable and projecting into the surface of said cable, holding said cam lock assembly locked to said wire cable.

3. A wire cable locking device for securing equipments, comprising:

(a) a plastic sheathed wire cable; said wire cable having a hard bulbous protrusion attached at one end and a metal sleeve attached to its distal end; said wire cable forming a loop at near its metal sleeve end;

(b) a metal ring; said metal ring being used to form said cable loop by passing the sleeve end of said cable through said ring, twice;

(c) a multiplicity of fastener blocks; said fastener blocks incorporating a first bore hole through which said cable sleeve end is threaded, retaining said blocks, said first bore hole being sized to allow clearance for the cable diameter but not permitting said cable end bulbous protrusion to pass; means for screw attachment of said fastener blocks to equipment; and (d) a cam lock assembly comprising:

a lock body member defining a planar zone having a width and depth;

first means including a first opening running through said lock body member and adapted to fit said wire cable diameter, allowing said wire cable to pass through said first opening;

second means including a cavity in said lock body member, said cavity spaced parallel to and adjacent to said first means;

third means including a lock element member, fitting in said lock body member cavity, having one position within said planar zone for locking and said lock element member;

said wire cable loop being passed around a relatively immovable fixture, through said ring and clamped by said cam lock assembly;

said fastener blocks being attached to equipment and being retained by said cable, preventing unauthorized removal of said equipment.

4. The wire cable locking device as defined in claim 3, wherein said means for screw attachment of said fastener blocks includes a second bore hole bored vertically near an edge of said fastener blocks perpendicular to and through said first bore hole, said second bore hole being countersunk to accommodate a screw head until near the bottom of said second hole; said second bore hole being sized to accommodate an equipment screw;

each said fastener block having a depth such that when an equipment screw is placed inside said second bore hole and screwed to an equipment, the placing of the cable horizontally through said first bore hole directly above the head of said equipment screw will block access to said equipment screw, preventing its removal.

5. The wire cable locking device as defined in claim 3, wherein a sufficient length of said wire cable projects through said lock body member of said cam lock assembly, said lock element member being pushed tight against said wire cable and projecting into the surface of said cable, holding said cam lock assembly locked to said cable.

* * * * *